US006095837A

United States Patent [19]

David et al.

[11] Patent Number: 6,095,837

[45] **Date of Patent: *Aug. 1, 2000**

[54] ELECTRICAL CONNECTOR WITH INTEGRAL SENSOR DEVICE

[75] Inventors: James J. David, Mechanicsburg; David F. Fusselman, Middletown, both of Pa.

[73] Assignee: Berg Technology, Inc., Reno, Nev.

[ * ] Notice: This patent is subject to a terminal disclaimer.

[21] Appl. No.: 09/088,146

[22] Filed: May 29, 1998

Related U.S. Application Data

[63] Continuation-in-part of application No. 08/706,117, Aug. 30, 1996, Pat. No. 5,800,192.

[51] Int. Cl.[7] ..... H01R 29/00

[52] U.S. Cl. ..... 439/188; 439/607; 439/610

[58] Field of Search ..... 439/607–610, 439/188–192

[56] References Cited

U.S. PATENT DOCUMENTS

| | | | |
|---|---|---|---|
| 4,426,558 | 1/1984 | Tanaka et al. . | |
| 4,501,459 | 2/1985 | Chandler et al. . | |
| 4,603,936 | 8/1986 | Jagen . | |
| 4,653,837 | 3/1987 | Phillipson et al. . | |
| 4,725,241 | 2/1988 | Bertini et al. . | |
| 5,052,940 | 10/1991 | Bengal . | |
| 5,055,058 | 10/1991 | Nagasaka et al. . | |
| 5,061,204 | 10/1991 | Murakami . | |
| 5,295,846 | 3/1994 | Sumida et al. . | |
| 5,338,215 | 8/1994 | Lee et al. . | |
| 5,348,484 | 9/1994 | Sorrentino . | |
| 5,378,172 | 1/1995 | Roberts . | |
| 5,470,251 | 11/1995 | Sano . | |
| 5,797,770 | 8/1998 | Davis et al. | 439/607 |
| 5,800,192 | 9/1998 | David et al. | 439/188 |
| 5,871,368 | 2/1999 | Erdner et al. | 439/188 |

FOREIGN PATENT DOCUMENTS 0 641 043 A2 1/1995 European Pat. Off. .

*Primary Examiner*—Lincoln Donovan
*Attorney, Agent, or Firm*—Brian J. Hamilla; M. Richard Page

[57] ABSTRACT

A receptacle adapted to be mounted on a printed wiring board (PWB) which includes an insulative member supporting a plurality of conductive contacts which conductive contacts engage the PWB and a conductive sheet having a lower wall superimposed on said PWB. An upper wall is superimposed over the insulative member in spaced relation over the lower wall and a pair of side walls perpendicularly interposed between said upper and lower walls to form a plug receiving space. A conductive sensor is positioned adjacent one of said conductive contacts and which contacts one of the conductive contacts when a plug is inserted in the plug receiving space. In an alternate embodiment a convex projection on the plug presses the power contact against the sensor.

14 Claims, 11 Drawing Sheets

ELECTRICAL CONNECTOR WITH INTEGRAL SENSOR DEVICE

CROSS REFERENCE TO RELATED APPLICATION

This is a continuation-in-part of application Ser. No. 08/706,117 filed Aug. 30, 1996 U.S. Pat. No. 5,800,192.

BACKGROUND OF THE INVENTION

1. Field of the Invention

The present invention relates to electrical connectors and more particularly to receptacles which are adapted to be mounted on a printed wiring board (PWB).

2. Brief Description of Prior Developments

Receptacles which are adapted to be mounted on a PWB are well known in the art. The universal serial bus (USB) receptacle, for example, has been proposed for universal use in many computer and computer peripheral applications. In the USB there is essentially an insulative member which houses a plurality of contacts which extend horizontally then vertically to engage the PWB. A conductive shield has an upper wall which is superimposed over the horizontal section of the insulated insert. The conductive shield also has a lower wall adjacent the PWB, and the upper and lower walls are connected with the vertical side walls to form a plug receiving cavity. One disadvantage of such receptacles is that they may provide no means for managing voltage drops due to mating of the plug and its attached cable assembly. Thus, for example, in system such voltage drops might cause the system to re-boot. There is, therefore, a need for a receptacle adapted to be mounted on a PWB which has an integral voltage drop monitoring device.

SUMMARY OF THE INVENTION

The receptacle of the present invention comprises a concave plug receiving means with a plurality of conductive contacts and a sensor means which is flexible to contact one of said conductive contacts to indicate the engagement of a plug with that contact. Such a receptacle would preferably be adapted to be mounted on a PWB and would include an insulative member supporting a plurality of conductive contacts. The conductive contacts engages the PWB. A conductive shield would surround the insulative member. The conductive shield includes a lower wall superimposed on said PWB and an upper wall superimposed over the insulative member in spaced relation over the lower wall. A pair of side walls are perpendicularly interposed between said upper and lower walls to form a plug receiving space between the wall and the insulative member. A conductive sensor means which is positioned adjacent one of said conductive contacts, and this sensor contacts one of the conductive contacts when a plug is inserted into the plug receiving space.

More preferably the receptacle comprises an insulative member comprising a first section extending from a base to an upper side and a second section extending perpendicularly from said vertical section to a terminal edge. The second section has a plurality of longitudinal slots. A plurality of conductive contacts extends first parallel to the second section of the insulative contact in the longitudinal slots. These contacts then bend perpendicularly to extend parallel to the first section of the insulative member. A conductive shield having a first side superimposed in spaced relation over the second section of the insulative member and a second side positioned in spaced relation beneath the second section of the insulative member. Opposed spaced lateral sides connect the first and second sides of the shield to form a plug receiving cavity between the second side and the second section of the insulative member. A conductive sensor has a first longitudinal section interposed in spaced relation between the contacts and the first section of the conductive shield. A second transverse section of the sensor extends perpendicularly to the first section of the insulative member. When a plug is inserted in the plug receiving cavity, one of the contacts is flexed to contact the sensor to indicate engagement of the plug and receptacle.

In an alternate embodiment there is a convex projection on the plug which presses against the power contact to engage the sensor.

BRIEF DESCRIPTION OF THE DRAWINGS

The invention is further described in the accompanying drawings in which.

DETAILED DESCRIPTION OF THE PREFERRED EMBODIMENTS

Figure 3:
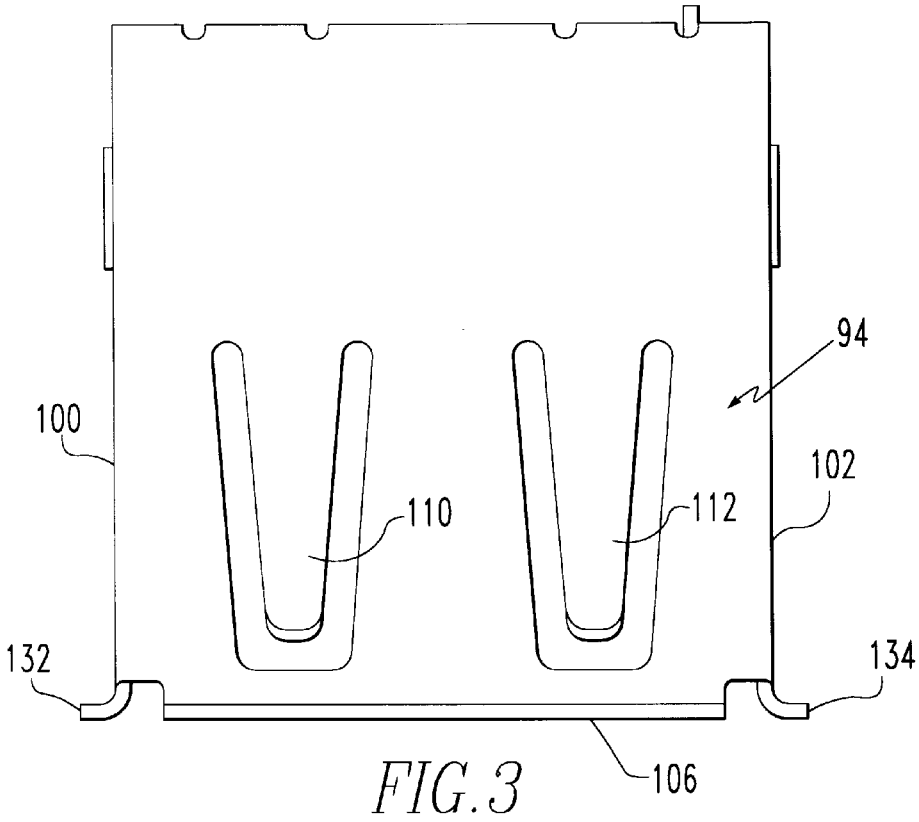
FIG. 3 is top plan view of the receptacle shown in FIG. 1.
Figure 1:
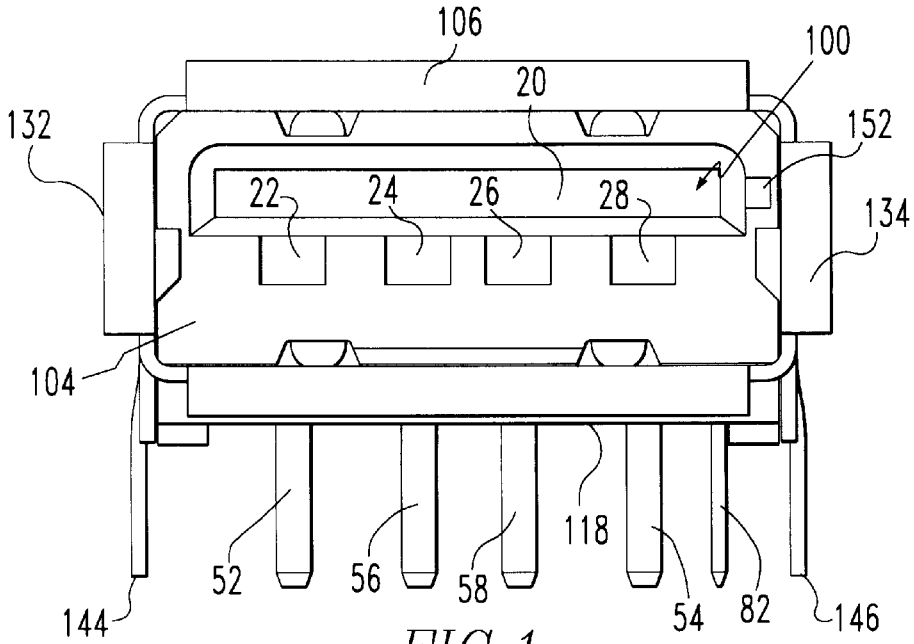
FIG. 1 is a front elevational view of a preferred embodiment of the receptacle of the present invention.
Figure 2:
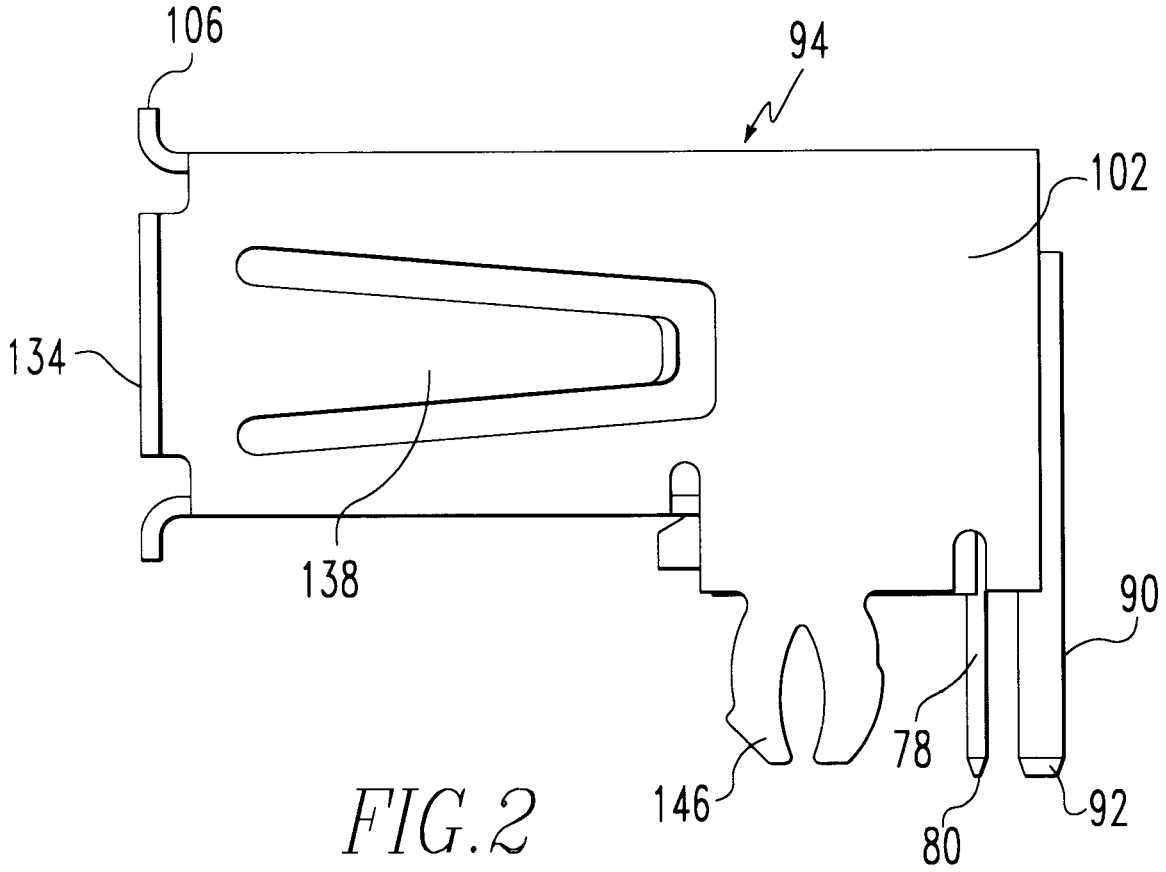
FIG. 2 is a side elevational view of the receptacle shown in FIG. 1.
Figure 4:
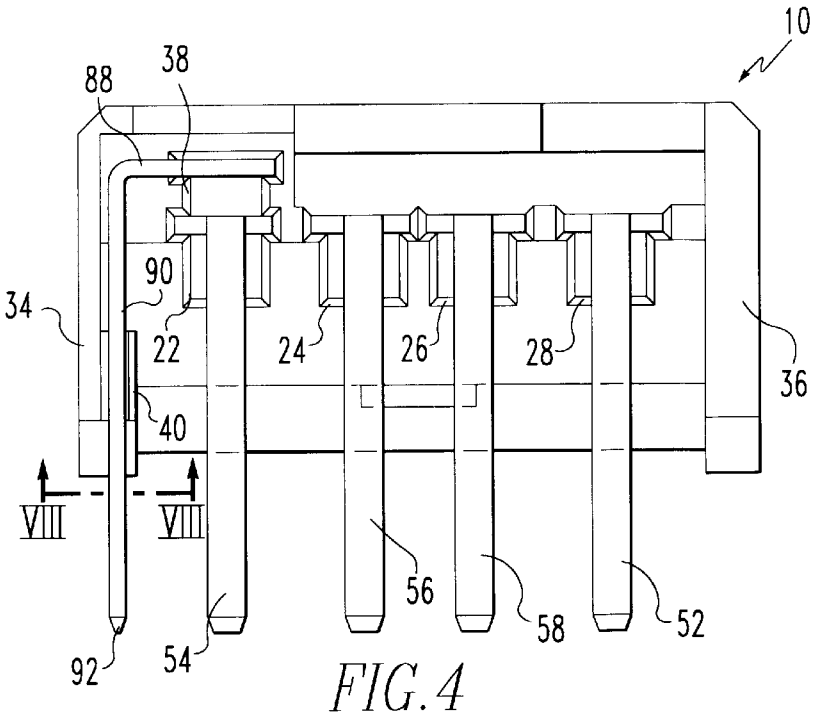
FIG. 4 is a rear elevational view of the receptacle shown in FIG. 1 in which the outer conductive shield has been removed.
Figure 5:
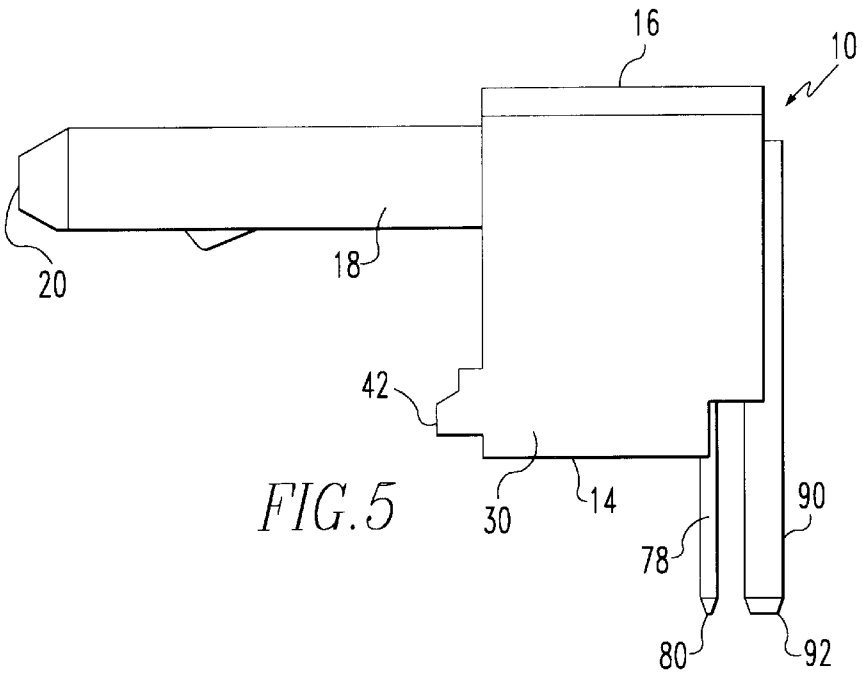
FIG. 5 is a side elevational view of the modified receptacle shown in FIG. 4.
Figure 6:
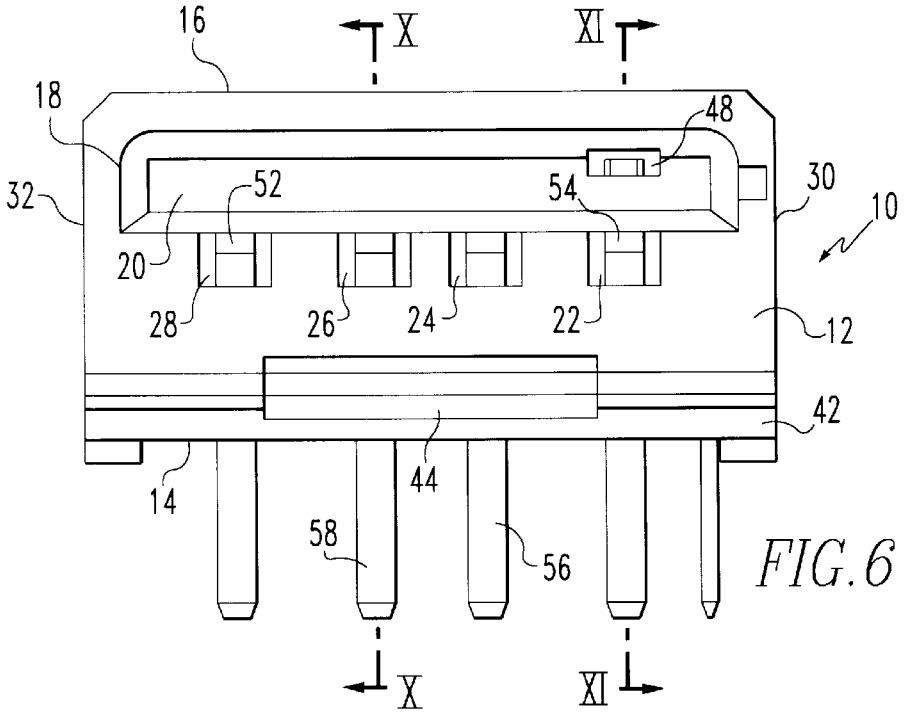
FIG. 6 is a front elevational view of the modified receptacle shown in FIG. 4.
Figure 7:
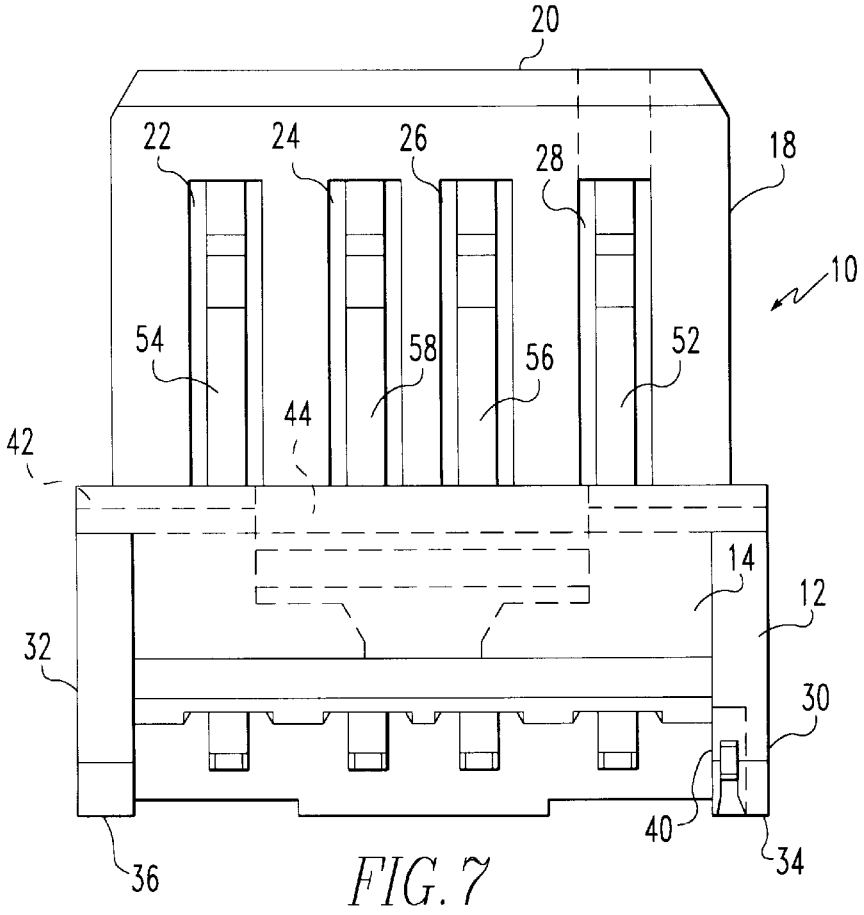
FIG. 7 is a bottom plan view of the modified receptacle shown in FIG. 4.
Figure 8:
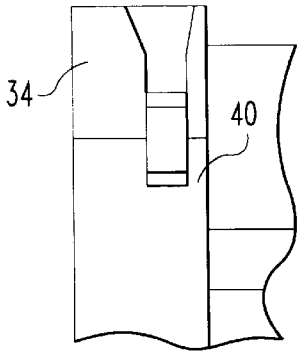
FIG. 8 is a cross sectional view through VIII—VIII in FIG. 4.
Figure 10:
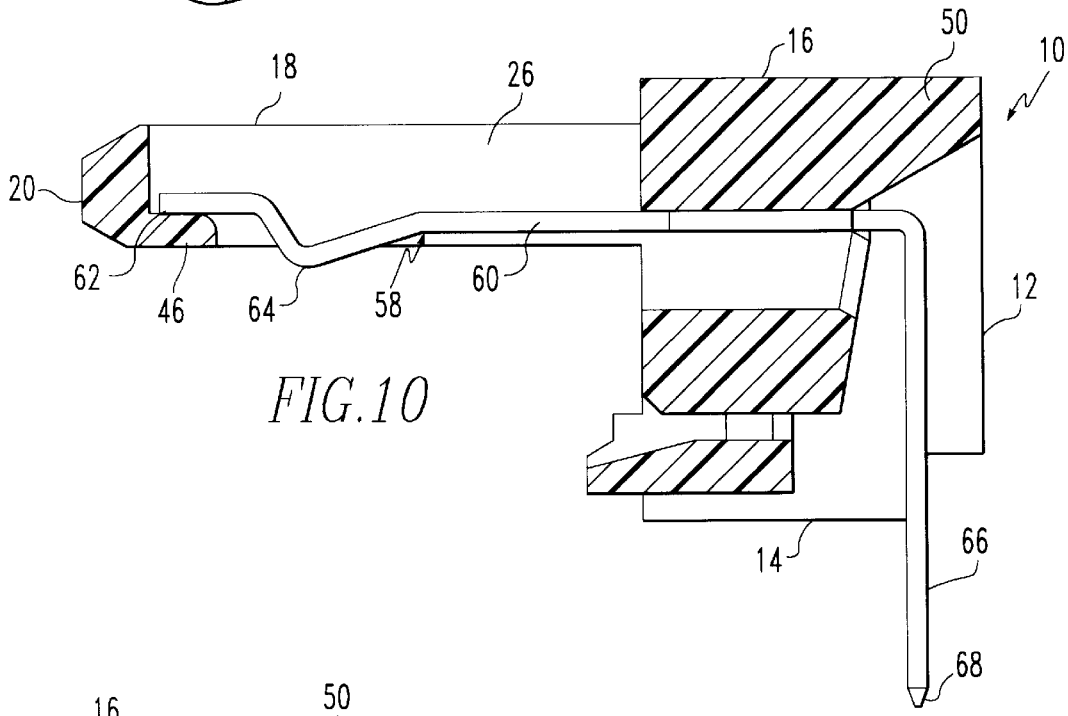
FIG. 10 is a cross sectional view through X—X in FIG. 6.
Figure 11:
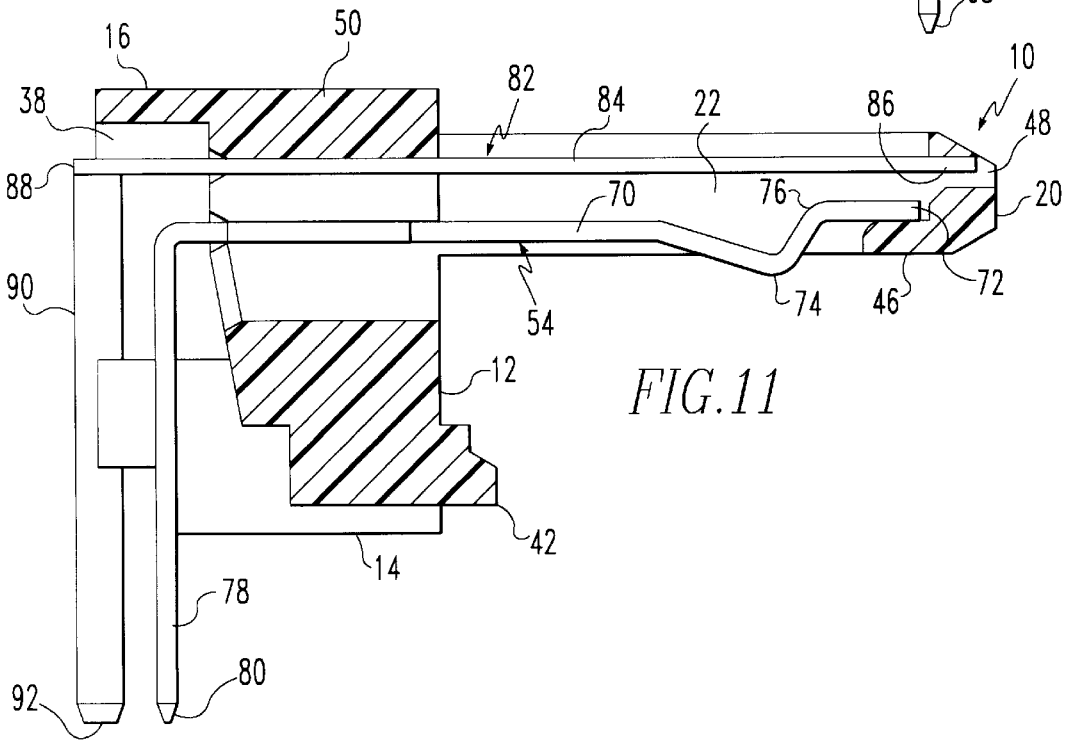
FIG. 11 is a cross sectional view through XI—XI in FIG. 6.
Figure 9:
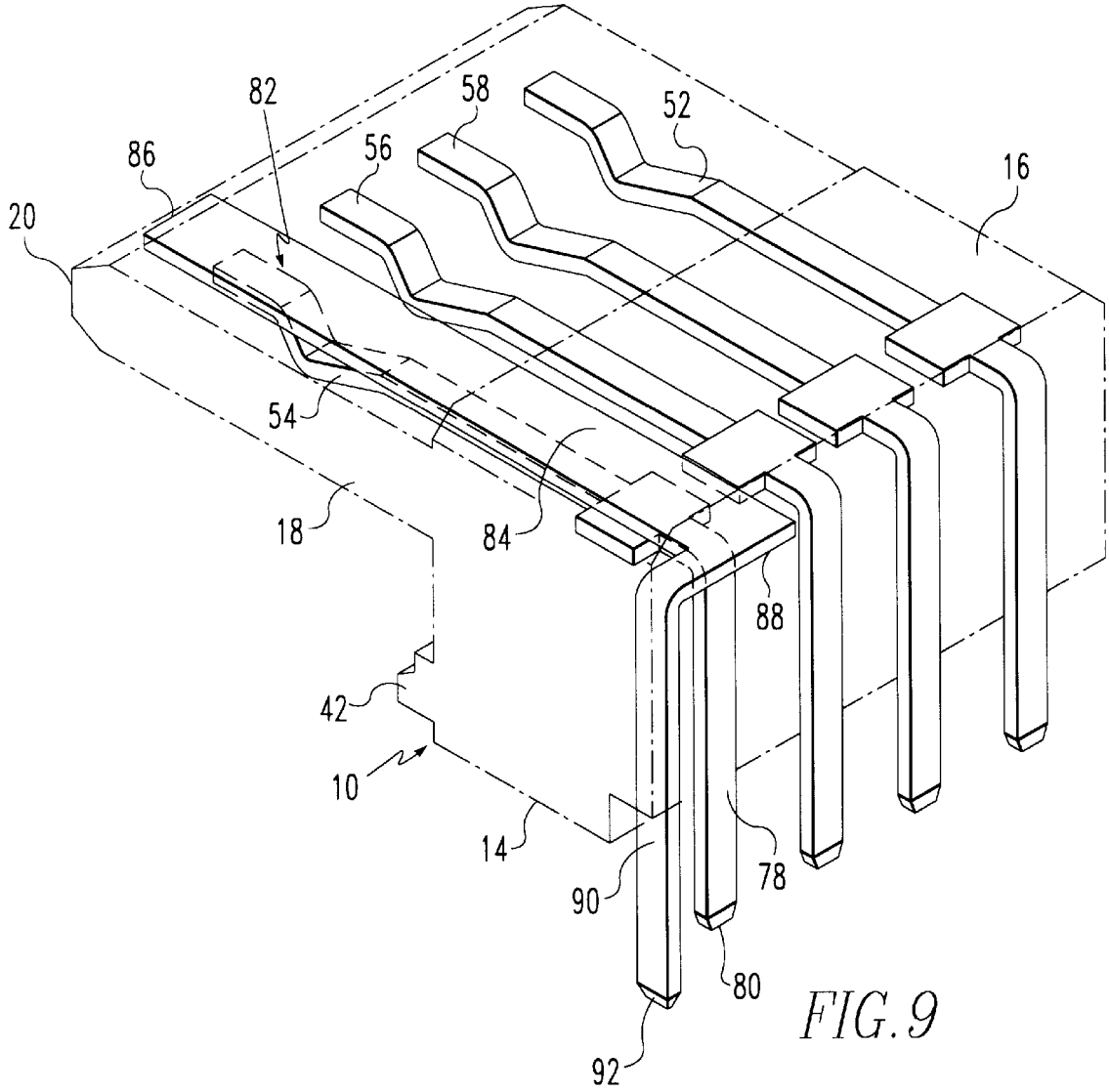
FIG. 9 is a perspective view of the insulative member and the contacts in the receptacle shown in FIG. 1.
Figure 12:
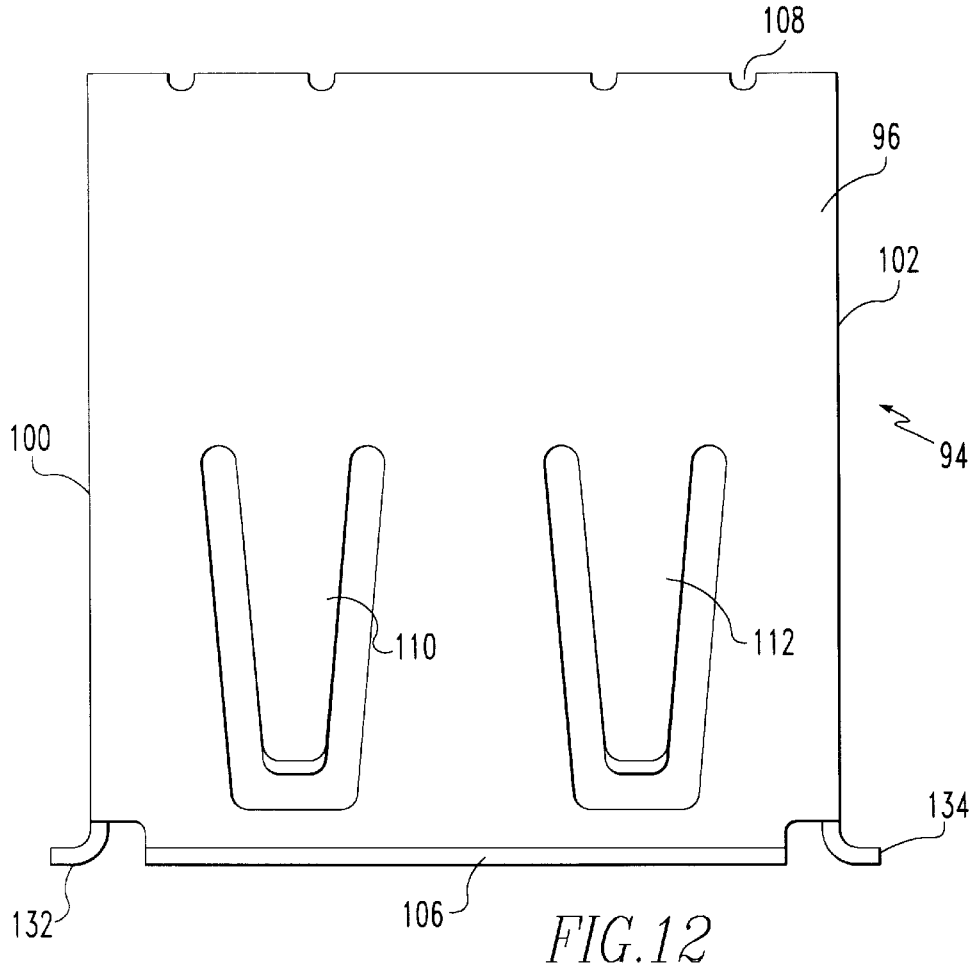
FIG. 12 is a detailed top plan view of the outer conductive shield only in the receptacle shown in FIG. 1.
Figure 13:
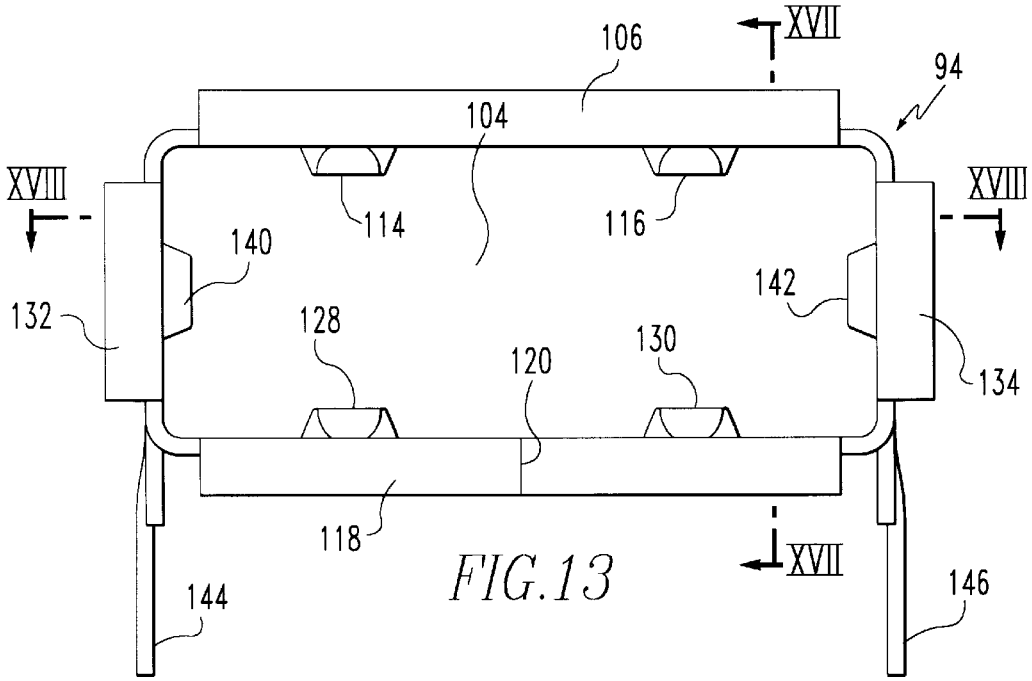
FIG. 13 is a front elevational view of the outer conductive shield shown in FIG. 12.
Figure 14:
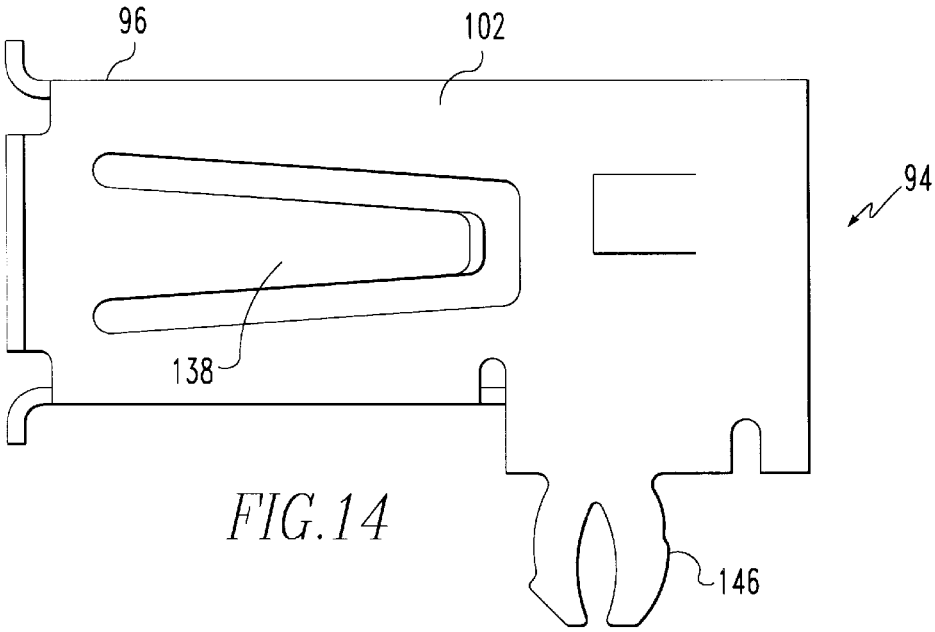
FIG. 14 is a side elevational view of the outer conductive shield shown in FIG. 12.
Figure 15:
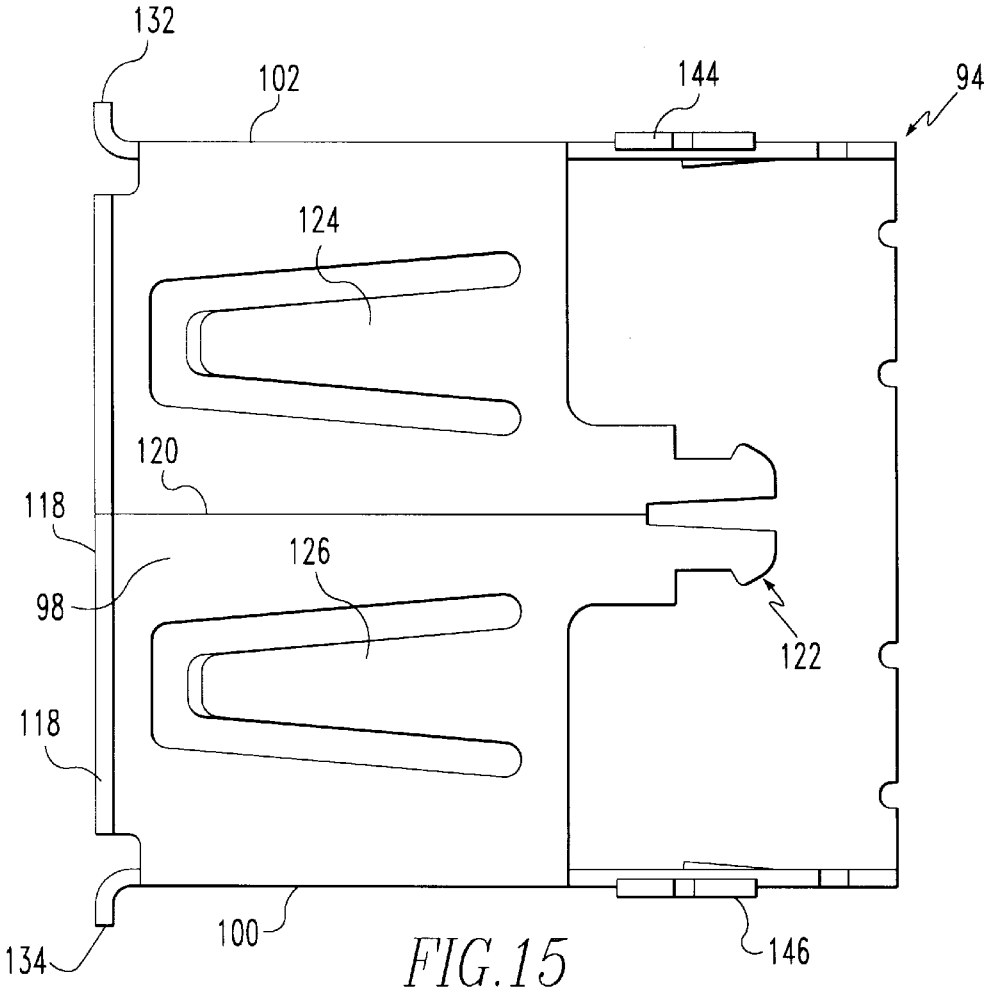
FIG. 15 is a bottom plan view of the outer conductive shield shown in FIG. 12.
Figure 16:
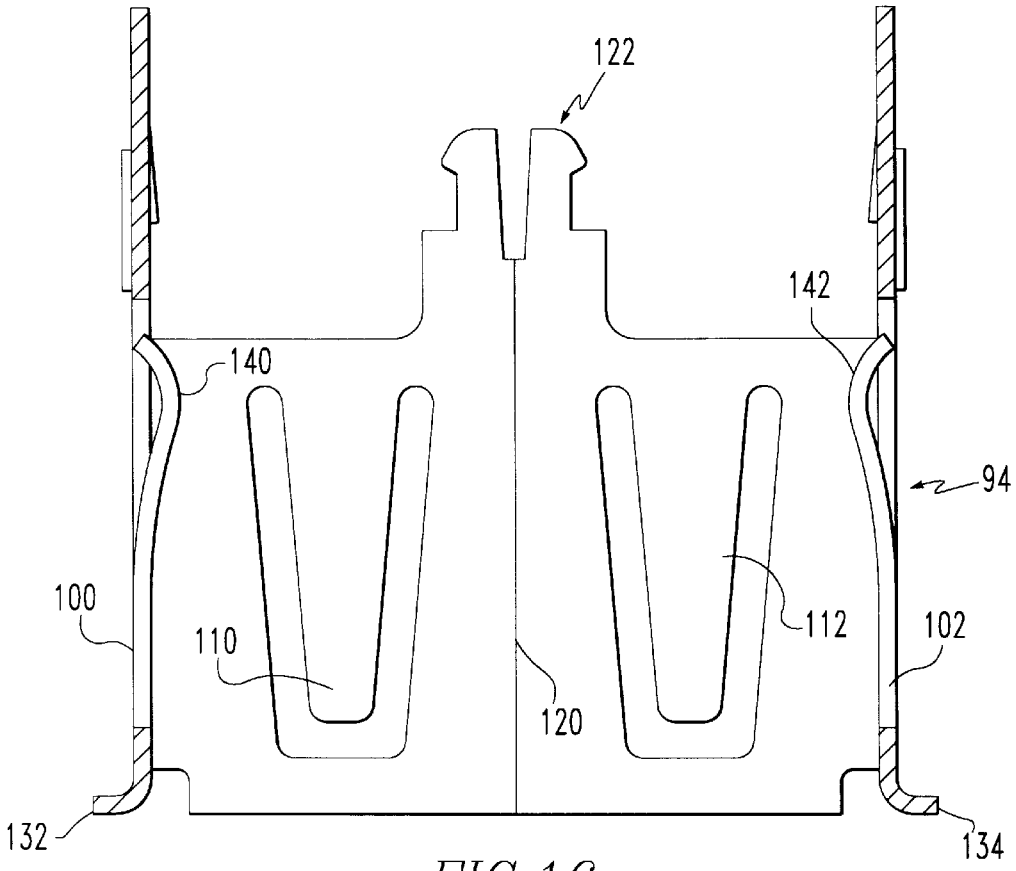
FIG. 16 is a cross sectional view through XVII—XVII in FIG. 13.
Figure 17:
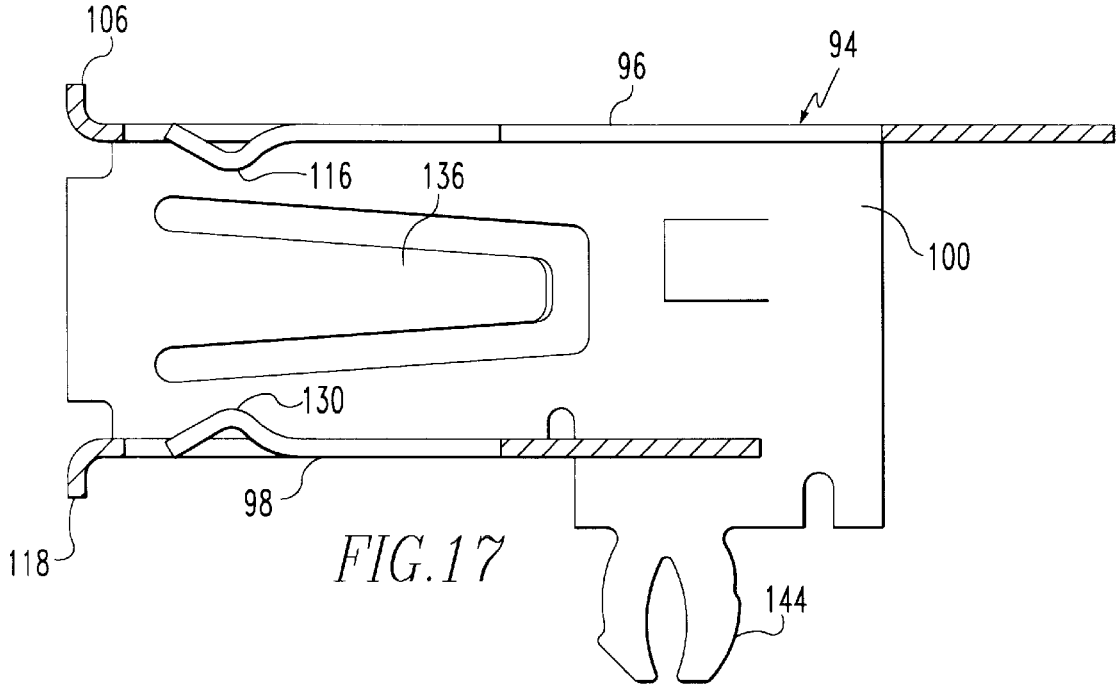
FIG. 17 is a cross sectional view through XVIII—XVIII in FIG. 13.

Referring to the drawings and particularly to FIGS. 1—11, the receptacle of the present invention includes an insulative member shown generally at numeral 10. This insulative member includes a first vertical section 12 which extends upwardly from a base 14 to an upper side 16. The insulative member then extends horizontally in a second section 18 to a terminal front edge 20. This second horizontal section 18 includes longitudinal contact receiving slots 22, 24, 26, and 28. The insulative members also have lateral sides 30 and 32 which extend rearwardly, respectively, in rearward lateral ridges 34 and 36. Superimposed above contact receiving slot 22 there is a sensor receiving slot 38. On the first section 12 of the insulated member there is also in opposed relation to the lateral ridge 34 a sensor retaining projection 40. On the forward side of the vertical first section there is a conductive shield retaining lip 42 which has a central clasp receiving aperture 44. Adjacent the terminal front edge of the horizontal second section 18, there is a front contact retaining lip 46 and a front sensor retaining aperture 48. At the opposite end of the horizontal second section of the insulated member there is a rear contact retaining structure 50. It will be understood, however, that all these contacts may be signal contacts and that any one of these contacts may be either a power signal or ground contact depending on system configuration. Inserted in the contact receiving slots there are positive and negative power contacts 52 and 54 and signal contacts 56 and 58. Referring particularly to FIG. 10, the signal contacts include a first horizontal section 60 which has a forward terminal end 62 that is engaged by the front contact retaining lip 46. This front section also includes a convex bend 64 which extends beneath the contact receiving slot. The signal contact 58 also includes a second vertical section 66 which extends downwardly parallel to the first vertical section of the insulative member to a PWB engagement end 68. Referring particularly to FIG. 11, each of the first mate contacts includes a first section 70 which is engaged at forward terminal end 72 by the front contact retaining lip 46 as well as a convex bend 74 and a sensor engagement point 76, the functions of which will be explained hereafter. The first mate contacts also have a second vertical section 78 which extend downwardly in parallel relation to the first vertical section of the insulative member to a terminal PWB engagement end 80. Superimposed over negative power contact 54 there is a sensor contact shown generally at numeral 82. This sensor contact has a horizontal first longitudinal section 84 with a front terminal end 86 that is retained in the front sensor retaining aperture 48 of the insulative member. At the front end of the first section there is a second transverse section 88 which extends perpendicularly from the first section across the vertical plane of contact 54 toward lateral ridge 34. Before reaching lateral ridge 34, the sensor contact extends downwardly in a third vertical section 90 between the lateral ridge and the sensor retaining projection 40 to a terminal PWB engagement edge 92.

Referring particularly to FIGS. 12–17, the outer conductive shield is shown in greater detail generally at numeral 94. This shield includes a top wall 96, a bottom wall 98 and opposed lateral walls 100 and 102. Between the insulative member and the bottom wall there is a plug receiving space 104. The top wall includes a front flange 106, a number of rear recesses as at recess 108 and longitudinal springs 110 and 112 which have respectively convex bends 114 and 116 that bear against the second section of the insulative member. The bottom wall includes a front flange 118 and is divided by a medial split 120 and has a rear clasp 122 which is inserted in the central class receiving gap 44 in the insulative member. The bottom wall also includes longitudinal springs 124 and 126 which have respectively convex bends 128 and 130 which bear against a plug (not shown) which would be inserted in the plug receiving cavity 104. The lateral walls 110 and 102 include, respectively, front flanges 132 and 134. They also include longitudinal springs 136 and 138 which have, respectively, convex bends 140 and 142 which bear against the lateral sides of the plug upon inserting as will be explained further below. The conductive shield is also equipped with hold downs 144 and 146.

Figure 18A:
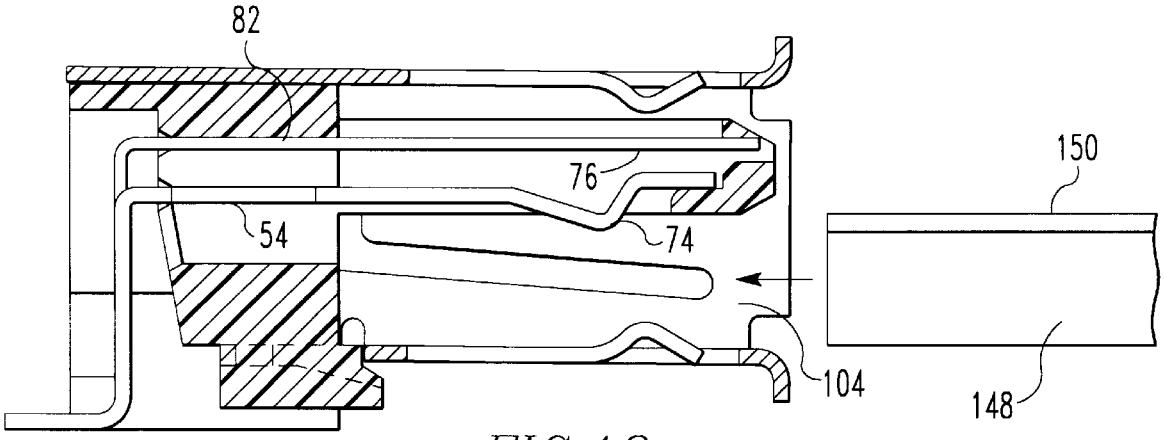
FIGS. 18*a* and 18*b* are cross sectional schematic views showing the functioning of the receptacle shown in FIG. 1 during the insertion of a plug.
Figure 18B:
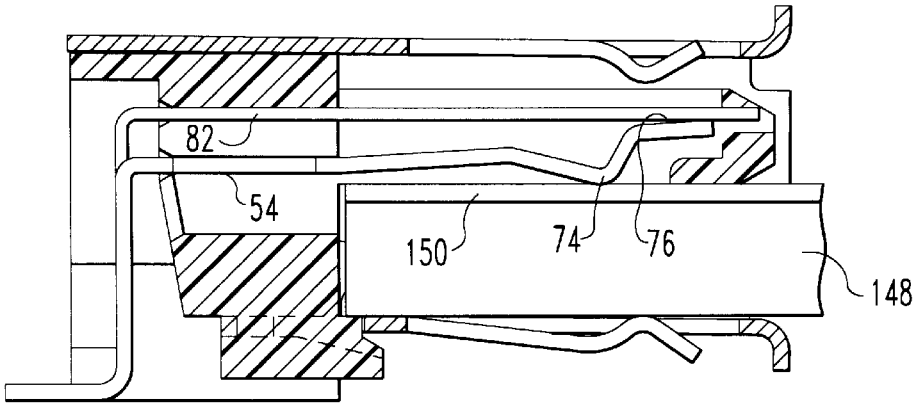

Referring to FIG. 18*a*, the receptacle is shown prior to engagement with a plug 148 which has a plurality of contacts 150. It will be seen that in this position the contact 54 is spaced from the sensor contact 82. When the plug is inserted into the plug receiving cavity 104 as is shown in FIG. 18*b*, the plug contact 150 bears against the convex bend 74 on the first mate contact to flex the first mate contact into contact with the sensor contact at the sensor engagement point 76 and thereby provide an indication of the engagement of the plug and the receptacle. It will be understood that the sensor contact does not necessarily have to be flexed to abut the negative power contact and that it may also, within the scope of this invention, abut the other negative power contact, a signal contact or a ground contact. The sensor may also abut or engage two or more other contacts. It will also be appreciated that two or more receptacles of the kind described herein may, within the scope of the invention, be vertically stacked on a PWB or that two or more such receptacles may be arranged laterally on a PWB in side by side abutting relation.

Those skilled in the art will also appreciate that a series "A" universal serial bus (USB) receptacle in which the contacts are arranged in a single horizontal plane may be modified to the practice of this invention by the addition of the sensor contact. In the same way, it will also be appreciated that a series "B" USB receptacle may be modified to the practice of this invention. That is, in the series "B" USB receptacle in which pairs of contacts are vertically aligned, it would be possible, for example, to position one or more sensor contacts between a vertically spaced pair of contacts so that the upper contact may be flexed downwardly to abut a sensor contact or the lower contact may bend upwardly to engage a sensor contact. It will also be appreciated that the application of this invention will in no way be restricted to USB receptacles and that it is widely applicable to other receptacles.

It will also be appreciated that it is not necessary that the sensor contact, within the scope of this invention, actually even touch another contact. Referring again to FIG. 1, for example, an additional sensor contact 152 is shown which extends parallel to the other contacts adjacent the shield. This sensor contact would also have a convex bend (not shown) which might extend outwardly through a slot in the side of the insulative member. When a plug is inserted the convex bend of this sensor contact would be engaged by the plug wall to push the sensor contact inwardly. Through the resulting connection to the grounded plug, engagement of the plug and receptacle would be indicated.

Figure 19A:
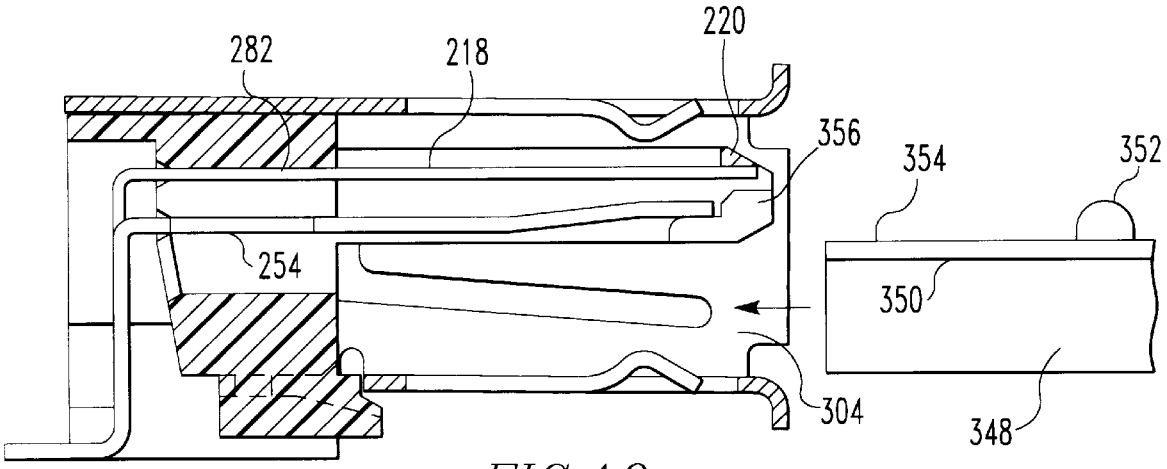
FIGS. 19*a* and 19*b* are cross sectional schematic views similar to FIGS. 18*a* and 18*b* showing the functioning of a receptacle and plug combination representing an alternate preferred embodiment of the connector of this invention.
Figure 19B:
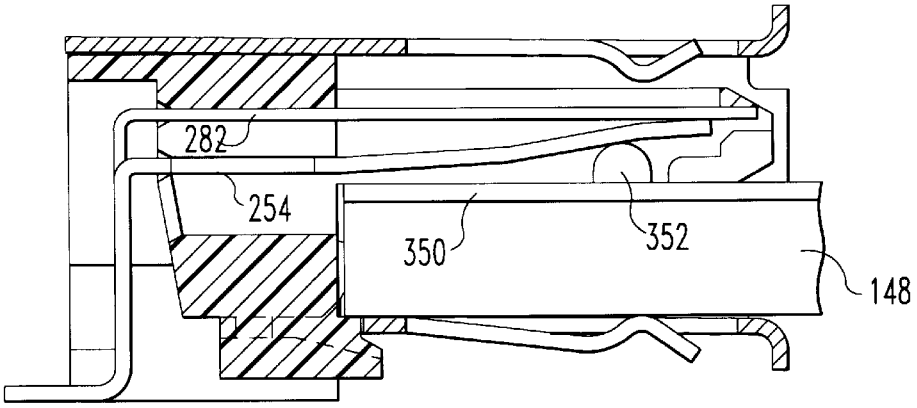

Another embodiment of this invention is shown in FIGS. 19*a* and 19*b*. Referring to FIG. 19*a*, the receptacle is shown prior to engagement with a plug 348 which has a plurality of contacts 350. The plug also has a convex projection 352 which extends upwardly from its top surface 354. There is also a gap 356 in the front edge 220 of the horizontal section 218 of the insulative member to allow insertion of the convex projection 352 into the cavity 304. It will be seen that in the position shown in FIG. 19*a* the contact 254 is spaced from the sensor contact 282. When the plug 348 is inserted into the plug receiving cavity 304 as is shown in FIG. 19*b*, the convex projection 352 bears against the negative power contact 254 to flex the first negative power contact into contact with the sensor contact 282 at the sensor engagement point 276 and thereby provide an indication of the engagement of the plug and the receptacle. It will be understood that the sensor contact 282 may also, within the scope of this invention, abut the other power contact, a signal contact or a ground contact. The sensor may also abut or engage two or more other contacts. It will also be appreciated that two or more receptacles of the kind described herein may, within the scope of the invention, be vertically stacked on a PWB or that two or more such receptacles may be arranged laterally on a PWB in side by side abutting relation.

It will be appreciated that there has been described a receptacle which is adapted to be mounted on a PWB and which provides an economical and efficient means of monitoring for voltage drops.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector adapted to be mounted on a printed wiring board (PWB) comprising:

(a) a receptacle comprising:

(i) an insulative member comprising a first section and a second section extending perpendicularly from said first section to a terminal edge and said second section having a plurality of longitudinal slots;

(ii) a plurality of conductive contact means extending first parallel to the second section of the insulative contact in the longitudinal slots and then parallel to the first section of the insulative member to be terminated to the to the PWB;

(iii) a conductive shield having a first side superimposed in spaced relation over the second section of the insulative member and a second side positioned in spaced relation beneath the second section of the insulative member and opposed spaced lateral sides connecting said first and second sides to form a plug receiving cavity between the second side and the second section of the insulative member;

(iv) a conductive sensor means spaced from the conductive shield and having a first longitudinal section interposed in spaced relation between said contact means and the first section of the conductive shield and a second section extending perpendicularly to the first section of the insulative member to be terminated to the PWB; and (b) a plug having a plurality of longitudinal conductive contacts inserted in the plug receiving cavity and there being a means for flexing one of the conductive contact means in the receptacle in response to insertion of the plug into the plug receiving cavity, so that said one of the conductive contact means engages with the sensor means.

2. The connector of claim 1 wherein the means for flexing one of said conductive contact means is a projection on which bears against said one of the conductive contact means in the receptacle when the plug is inserted into the plug receiving cavity.

3. The connector of claim 2 wherein the projection is a convex projection.

4. The connector of claim 3 wherein the plug has a top side and the convex projection is positioned on the top side.

5. The receptacle of claim 1 wherein the insulative member has lateral sides and the second transverse member of the conductive sensor means extends outwardly over one of the lateral edges of the insulative members.

6. The receptacle of claim 5 wherein the conductive sensor means is spaced from the conductive shield.

7. The receptacle of claim 5 wherein a plug having a plurality of longitudinal conductive contacts is inserted in the plug receiving cavity and one of said contacts bears against one of the contacts in the receptacle to push said contact in the receptacle against the sensor means.

8. The receptacle of claim 7 wherein said contact in the receptacle which is pushed against said sensor means has a convex bend.

9. The receptacle of claim 8 wherein the contact in the plug bears against said convex bend.

10. The receptacle of claim 9 wherein the contact which bears against the sensor means is a power contact.

11. The receptacle of claim 10 wherein the contact which bears against the sensor means is adjacent one of the lateral sides of the insulative member.

12. The receptacle of claim 11 wherein the lateral side of the insulative member adjacent said contact means which bears against the sensor means is the same lateral side over which the sensor means extends.

13. The receptacle of claim 1 wherein the conductive contact means are terminated to the PWB.

14. The receptacle of claim 13 wherein the sensor means is terminated to the PWB.

* * * * *